US005224773A

United States Patent [19]

Arimura

[11] Patent Number: 5,224,773

[45] Date of Patent: Jul. 6, 1993

[54] LANTERN AND A LENS FOR THE SAME

[75] Inventor: Tadahiro Arimura, Osaka, Japan

[73] Assignee: Zeni Lite Buoy Company, Ltd., Osaka, Japan

[21] Appl. No.: 674,611

[22] Filed: Mar. 25, 1991

[30] Foreign Application Priority Data

Mar. 26, 1990 [JP] Japan ..... 2-77244
Mar. 12, 1991 [JP] Japan ..... 3-127034

[51] Int. Cl.[5] ..... F21V 5/02

[52] U.S. Cl. ..... 362/227; 362/320; 362/332; 362/340; 362/800

[58] Field of Search ..... 362/227, 240, 244, 320, 362/332, 339, 340, 337, 363, 800

[56] References Cited

U.S. PATENT DOCUMENTS

| | | | |
|---|---|---|---|
| 516,824 | 3/1894 | Knowles | 362/244 |
| 2,395,756 | 2/1946 | Parsons | 362/337 |
| 2,752,478 | 6/1956 | Clark | 362/332 |
| 3,504,338 | 3/1970 | Bailey | 362/263 |
| 3,544,785 | 12/1970 | Weibel | 362/332 |
| 3,711,704 | 1/1973 | Spiteri | 362/337 |
| 4,574,338 | 3/1986 | Takahashi et al. | 362/320 |
| 4,580,201 | 4/1986 | Williams | 362/363 |
| 4,638,411 | 1/1987 | Trainor | 362/337 |
| 4,670,823 | 6/1987 | Kochi et al. | 362/336 |
| 4,729,076 | 3/1988 | Masami et al. | 362/800 |
| 4,839,782 | 6/1989 | Sikor | 362/363 |
| 4,954,936 | 9/1990 | Kawabata et al. | 362/249 |
| 4,984,142 | 1/1991 | Garnerone | 362/249 |

*Primary Examiner*—Richard R. Cole
*Attorney, Agent, or Firm*—Koda and Androlia

[57] ABSTRACT

A beacon lantern and a lens for the same with improved light transmission factor, which is easy to manufacture and uses LEDs as a light source. A lantern comprising light source of many LEDs radially distributed on a horizontal circumference and a cylindrical fresnel lens converging beams of light in all horizontal directions, in which the lens is made by rolling a sheet-like, fine prism-shaped linear fresnel lens into a shape of a cylinder. The lantern maintains a top lid and a lower lantern body with a prescribed distance therebetween by way of a center bolt, between said lid and lower lantern body a transparent cylindrical cover is maintained, on the inner surface thereof is the rolled sheet-like linear fresnel lens joined therewith.

29 Claims, 7 Drawing Sheets

LANTERN AND A LENS FOR THE SAME

BACKGROUND OF THE INVENTION

1.Field of the Invention

The present invention relates to improvements made to a beacon lantern and a lens for the same using LEDs as light source.

2. Prior Art

A variety of attempts have been made to use an LED as light source of a beacon lantern because of its small power consumption. Especially, automatic dispatching lanterns combined with solar batteries have been used.

Because an LED has a limited light-emitting energy by itself, a lens is incorporated in front or the LED itself to converge a beam of light and increase luminance thereof. However, if a plurality of LEDs of large convergence rate are used, beams of light are not distributed in all horizontal directions evenly. Instead, there will be strong and weak beams of light distributed horizontally. Therefore, in order to evenly distribute light horizontally, it is necessary to use LEDs of a relatively larger divergence angle and to eventually converge beams of light horizontally through a cylindrical fresnel lens.

In order to make a thin cylindrical fresnel lens, the lens includes a main lens part and a multi-layered annular part provided above and below the main lens part, and the light-emitting surface of which corresponds to the lens surface and consists of a curved surface requiring precision in forming. FIG. 14 shows a schematic view of such lens.

Cast glass has been used as a material for a cylindrical fresnel lens for waterway beacon lighting equipment. However, because of various reasons such as mold precision, casting, mold releasing and rolling process, it has been impossible to manufacture a high performance lens.

Recently, high performance cast cylindrical lenses are produced by the use of a plastic injection molding method. But this method comes with a limitation as to securing a proper thickness of the cylindrical lens. Either way, molds for the casting require high precision and are expensive. In the case of plastic lens, a certain volume has to be continuously provided in order to stabilize the quality, thereby resulting in high manufacturing cost.

Demand for waterway beacon lenses is very small compared to general commodities. The combination of special attributes of the lens, expensive mold, limited production volume and severe performance requirements have made development of a new lens for a demanded purpose very difficult. As a result, a lantern using such cylindrical fresnel lens has been expensive and there has been a great transmission loss of light.

The thinner the lens, the less light is lost through the lens. Therefore, the smaller the pitch between the rings of the fresnel lens, the thinner the lens can be made. Recent improvement in machining precision of molds and progress in plastic materials have made a pitch of 0.1 mm possible. Also, if the pitch is made small, sufficient precision can be obtained even if the vertical section of the light-emitting surface is processed linearly, i.e., in a prism shape, instead of a curved line, thereby making designing and machining of a mold very easy.

SUMMARY OF THE INVENTION

The lens used in the present invention is a cylindrical lens made of a thin cylinder or thin frustum of a cone which forms a fine prism-shaped fresnel surface. Instead of plastic injection molding, the method of the present invention uses a mold for a small-pitch thin linear lens, i.e., a lens with constant-pitch focal points arranged linearly, which is a plane development of a cylindrical fresnel lens, and a thin flexible plastic plate is heated and pressed to make a thin-plate-shaped linear lens, which is rolled so that the fresnel center line forms a horizontal ring, thereby forming a cylindrical lens with a shape of a cylinder or frustum of a cone to be used for a lantern or a lens thereof.

A flat metal plate for the mold is machined by a milling machine or a thin metal plate for the mold is wound around the lateral surface of the cylinder for machining with a lathe to make a fresnel surface, which is taken off and spread into a flat plate, and then heated and pressed onto a flexible transparent resin film to form a fine prism-shaped linear fresnel surface. If the thin metal plate for the mold is wound around the frustum of a cone and machined by lathe and spread into a flat plate, it becomes a flat mold for a cylindrical lens of a frustum of a cone.

The present invention is about a lantern comprising the light source of many LEDs radially distributed on a horizontal circumference at a constant pitch and a cylindrical fresnel lens converging beams of light in all horizontal directions, in which the cylindrical fresnel lens is made by rolling a transparent film with a fine prism-shaped linear fresnel lens formed on the surface thereof, into a shape of a cylinder or a frustum of a cone.

It is also about a lantern lens as described above, which includes a transparent cover embedding a solar battery at the upper inner surface thereof; a flasher unit case in which the upper edge of the cylindrical fresnel lens is inserted into and fastened at the upper periphery thereof, a flasher unit is housed therein. and a light source is supported in the bottom center thereof and mounted on the lower surface of the upper pat of the cover; and a lens support that is inserted into and fastened at the lower inner surface of the cover and supports the lower edge of the cylindrical fresnel lens; in which the thin cylindrical fresnel lens is supported concentrically with the cover maintaining a small gap between the lens and the inner surface of the cover.

The present invention is also about a lens for a lantern made by rolling a thin transparent film with a fine prism-shaped linear fresnel lens formed on the surface thereof and joining it to the inner surface of a cylinder or a frustum of a cone.

It is also about a lantern lens as described above, which comprises a linear fresnel lens that is joined to the inner surface of the cover and provided with longitudinal contact joints and divided in the direction of the circumference.

It is also about a lens for a lantern made by rolling a thin transparent film with a fine prism-shaped liner fresnel lens formed on the surface thereof and joining the same to the inner surface of a transparent cylindrical cover, in which several liner fresnel lenses are arranged parallel in the longitudinal direction so as to contact the other.

It is also about a lens for a lantern in which the above-mentioned several linear fresnel lenses are formed on a single transparent film surface.

It is also about a lens for a lantern in which several linear fresnel lenses are arranged in the longitudinal direction and provided with longitudinal contact joints.

It is also about a lantern in which the lower lantern body and a top lid are supported by a center bolt, and a lantern lens is inserted into cover-gripping slits individually established on the lower lantern body and the top lid, and many LEDs are arranged radially at the focal circle of the lantern lens.

It is also about a lantern with a similar construction as the above-mentioned lantern, in which the light source of many LEDs is provided in multiple levels, and lantern lenses are established in multiple levels so as to correspond to each level of the LEDs, the lantern lenses are connected by a ring or rings that is or are provided with slits on the upper and lower surfaces thereof.

It is also about a lantern as described above, in which the lantern lens cover is made of a single cover comprising an upper part and a lower part, and inside which a required number of upper and lower fresnel lenses are joined to the inner surface of the cover either individually with the upper and lower lenses contacting each other or as a single piece.

It is also about a lantern that is constructed airtight, and a desiccant is provided therein to prevent dew condensation of the fresnel lens.

In the above-mentioned construction, the use of LEDs saves energy consumption and eliminates the possibility of disconnection; the cylindrical fresnel lens converges beams of light in all horizontal directions and transmits light over a long distance; and the LEDs of relatively larger divergence angle evenly distribute light in all horizontal directions without fluctuation. Moreover, because the cylindrical lens is extremely thin, the transmission loss is very small. A fine prism-shaped linear fresnel lens is formed on the thin, transparent film to make the manufacture very easy. The diameter of the cylindrical fresnel lens can also be changed easily, making alteration of the diameter of the focal point quite easy. As a result. a prescribed number of LEDs can easily be arranged on the circumference.

By rolling a thin, transparent film with a fine prism-shaped linear fresnel lens formed thereon and making it join with the inner surface of the transparent cylindrical or frustum cover, a fresnel lens for a beacon lantern that is easy to make and change the diameter thereof is provided.

The center bolt of the lantern fastens the lower lantern body and the top lid so that a tightening torque is evenly applied to the lantern lens cover, and no strong force is applied locally, making possible a thin cover and improved transmission factor.

Because the lantern lens is made by joining the film of a linear fresnel lens to the inner surface of the cylindrical cover, longitudinal contact joints are provided to the development of the film and are joined each other. This makes the length of a mold fractional. Several lenses can be arranged parallel in the longitudinal direction to make multiple levels of LEDs bases for a large lantern using a mold for a small linear fresnel lens. Moreover, by forming linear fresnel lens molds parallel in the longitudinal direction, a single sheet comprising several fresnel lenses longitudinally can be made for better productivity.

The fine linear fresnel lens loses its lens function if water droplets collect on the surface thereof; therefore, the lantern especially used in the region of cold climate is best made by sealing the area such as the gap between the cover and the top lid and the lower lantern body, the electric-wire-penetrating part and the center-bolt-penetrating part of the lower lantern body with a packing, sealing material and an O-ring airtight electric-wire-penetrating fixture to make the lantern airtight. It is even better if a desiccant is provided within the lantern to prevent dew condensation of the fresnel lens. As such, the LED will not disconnect and can be used semi-permanently with no need for any maintenance.

DETAILED DESCRIPTION OF THE INVENTION

Figure 1:
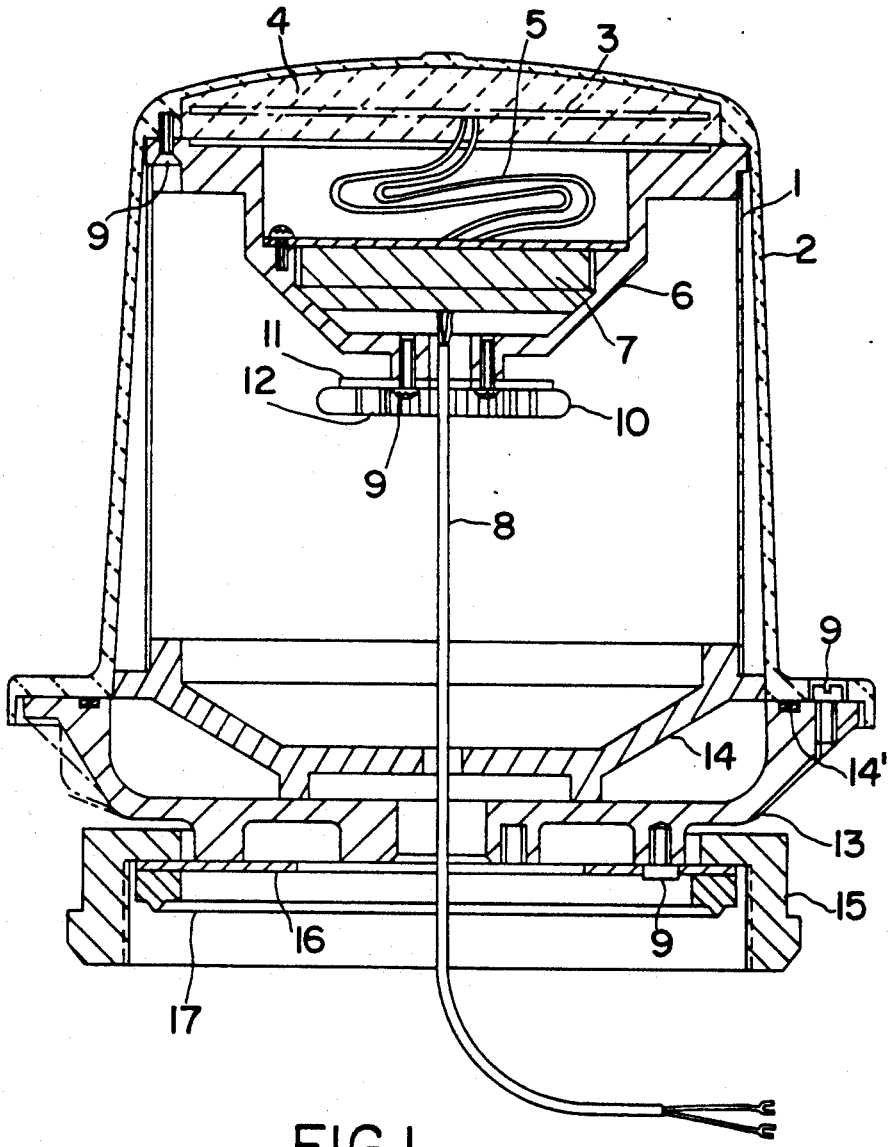
FIG. 1 is a central cross sectional view of an embodiment of the present invention.

FIG. 1 shows a central cross section of a lantern embodying the present invention. Reference numeral 1 is a thin fresnel lens made by rolling and welding the edges of a thin, transparent film of acrylic resin, etc. with a fine-pitched surface (see FIG. 10) that is formed by heating and pressing a mold for a thin linear fresnel lens to form a cylinder. The thickness of the transparent film is 0.5 mm, and the pitch between serrations of the linear lens is 0.1 mm in this embodiment. The edges are overlapped and ultrasonically welded.

Because the joint has no lens effect, the overlap should be as small as possible: approximately 2 mm in this embodiment. The overlap of this scale hardly affects the effect of the lantern because of the many light sources that are distributed on the horizontal circumference. Furthermore, the joint is perpendicular and parallel to the cylindrical center in this embodiment, but by arranging it to be a little diagonal, the effect of the joint will be none even if the light source is in the center of the cylinder. In order to narrow the width of the joint, the contacting end faces can adhere to each other. In order to secure a sufficient adhesion area, the mutually-facing parts can be bent at a right angle to make narrow flanges to adhere to each other. In this embodiment, the fresnel lens surface is on the outer surface, but it can be established on the inner surface as well. Also in this embodiment, the fresnel lens 1 is a cylindrical shape, but it can also be a frustum of a cone with a tapered lateral surface.

Reference numeral 2 is a transparent cover with a flanged bottom. Inside the cover, at the upper part, there is a solar battery panel 3 molded in a transparent silicon 4, which releases heat and avoids temperature rise. Together with the curved top surface, it increases the convergence effect by the lens effect to improve the power generating performance of the panel. Reference numeral 5 is a lead, 6 is a flasher unit case, 7 is a flasher unit, 8 is a lead line connecting the flasher unit and the battery, 9 is a set screw, 10 is a set of LEDs, 11 is a base; and in this embodiment fourteen LEDs are arranged radially on a horizontal circumference on the bottom surface of the base 11, and a spacer 12 is used to mount the LEDs precisely at the same level in the horizontal radial direction. Reference numeral 13 is a base flange supporting a lens mount 14 made of rubber, and the lens mount 14 and the flasher unit case 6 support a super thin cylindrical fresnel lens 1 so as to maintain its roundness.

Reference numeral 15 is a union that is used to mount the lantern onto the beacon, 16 is a mounting plate, 17 is a packing, and 14' is an O-ring. In this embodiment, by mounting the flasher unit at the upper part inside the cover, the lead of the solar battery can be housed in the flasher unit case so as to avoid application of tension to the lead. Even if water comes into the cover and stays in the lower part therein, the flasher unit itself can escape flooding.

Figure 2:
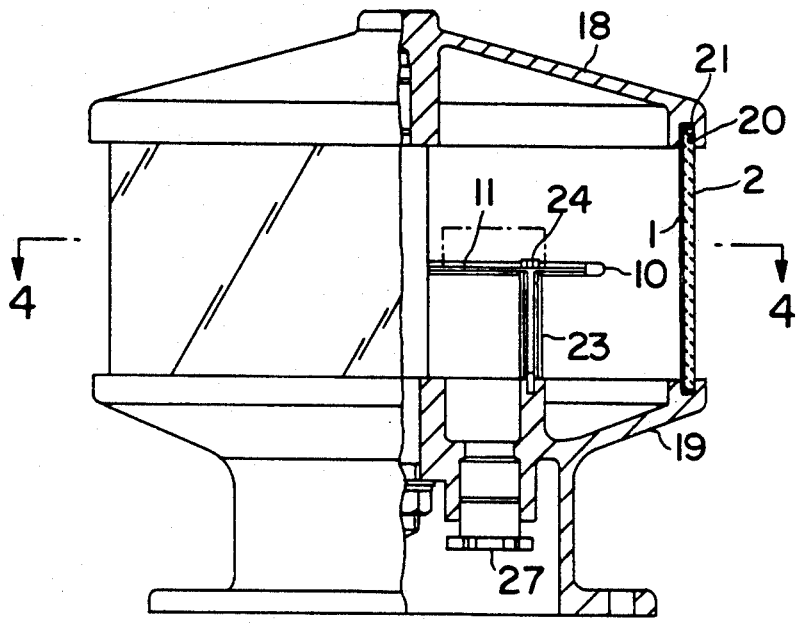
FIG. 2 is a partially cut-off front view of a lantern of another embodiment.
Figure 3:
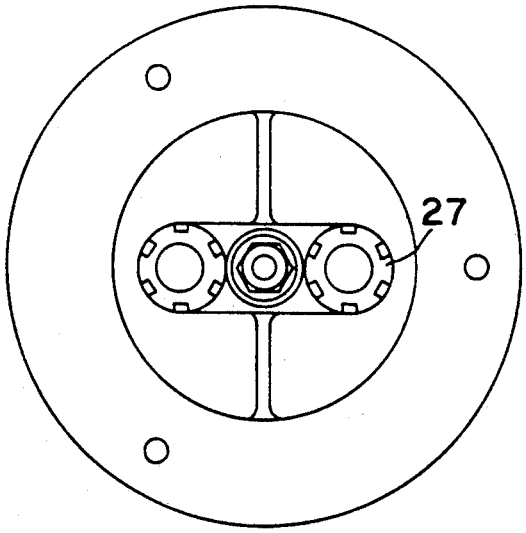
FIG. 3 is a bottom-view of FIG. 2.
Figure 4:
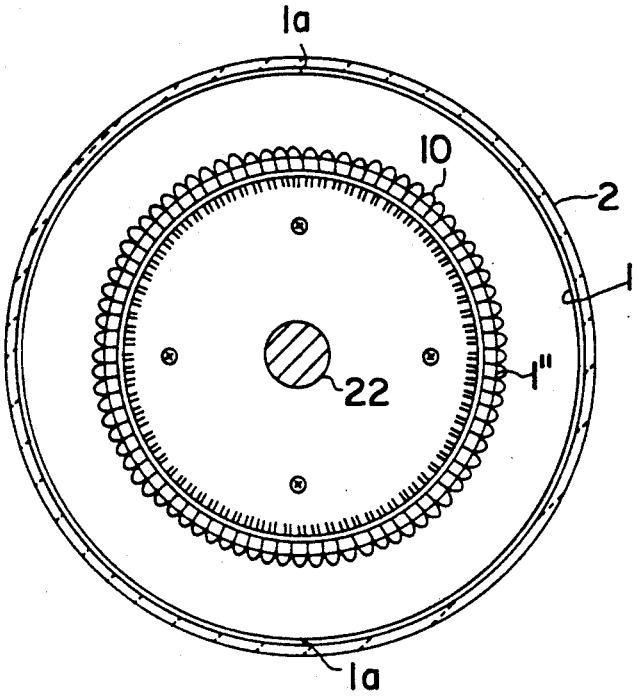
FIG. 4 is a cross sectional view taken along the line 4—4 of FIG. 2.

FIG. 2 is a partial cross section showing a lantern and a lantern lens of another embodiment of the present invention, FIG. 3 is a bottom view thereof, and FIG. 4 is a cross sectional view taken along the line 4—4 of FIG. 2.

Reference numeral 1 is a thin fresnel lens made by rolling a thin transparent film with a fine prism-shaped linear fresnel lens formed on the surface thereof, which is made to join with the inner surface of the cover of a transparent cylinder 2 to constitute a lantern lens. The film of the linear fresnel lens is elastic; therefore, it is sufficient that it is bent and made to join with the inner surface of the cylinder cover to secure proper adhesion thereto. As a result, despite its super thinness, it is easy to maintain its roundness, and the edges will only have to be put together and need not adhere to each other; therefore, it is easy to assemble the lens with no seam joint.

The diameter of the focal circle 1'' of the lens can be freely selected by simply adjusting the diameter of the cylinder and the lateral length of the linear fresnel lens, so that the number of LEDs 10 to be arranged on the focal circumference 1'' can also be freely adjusted for easy increase of lighting power. In this embodiment, eighty LEDs 10 are arranged on the base 11.

Reference numeral 18 is a top lid, 19 is a lower lantern body, each having a slit into which the upper end and the lower end of the lantern lens comprising the transparent cylindrical cover 2 and the thin fresnel lens are inserted respectively, while the packing keeps the whole unit watertight. Reference numeral 22 is a center bolt supporting the top lid 18 at a certain height over the lower lantern body 19. The center bolt makes possible a simple construction of the lantern, and helps avoid excessive force to be applied to the cylinder cover 2; therefore, the transparent cylinder cover can be made thin, contributing to better transmission factor of the light of the lantern.

The base 11 is mounted at a prescribed height onto the lantern support 19 via bolts 24 that run through supporting columns 23.

In this embodiment, the thickness of the film of the thin fresnel lens 1 is 0.5 mm, and the thickness of the transparent cylinder cover 2 is 3 to 4 mm.

The thin fresnel lens 1 is best made by rolling a sheet of thin linear fresnel lens into a cylinder, but that is not absolutely necessary. Instead, in order to use a small press or mold, several divided fresnel lenses can be put to join the inner surface of the cylinder cover. In this embodiment, the diameter of the cylinder is 230 mm, and the lens part is divided into two as shown in FIG. 4 with two discontinuities la, so that a small press or mold will suffice. Even then the elasticity of the film is sufficient to press the film against the inner surface of the cover. For larger lanterns, the lens part can be divided into three or four for economical reasons.

Figure 5:
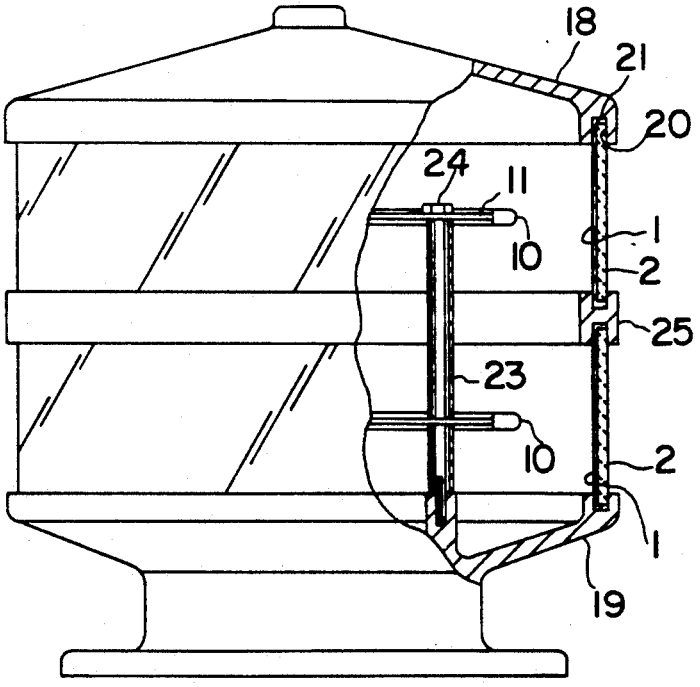
FIG. 5 is a partially cut-off front view of a lantern of another embodiment.

FIG. 5 is an embodiment in which the lantern shown in FIG. 2 is doubled to make a larger lantern. A lantern lens is mounted over the other lantern lens via a ring 25 that has slits 20 on the top and bottom thereof, and two bases 11 are mounted on the lower lantern body 19 via bolts 24 that run through supporting columns 23.

Figure 6:
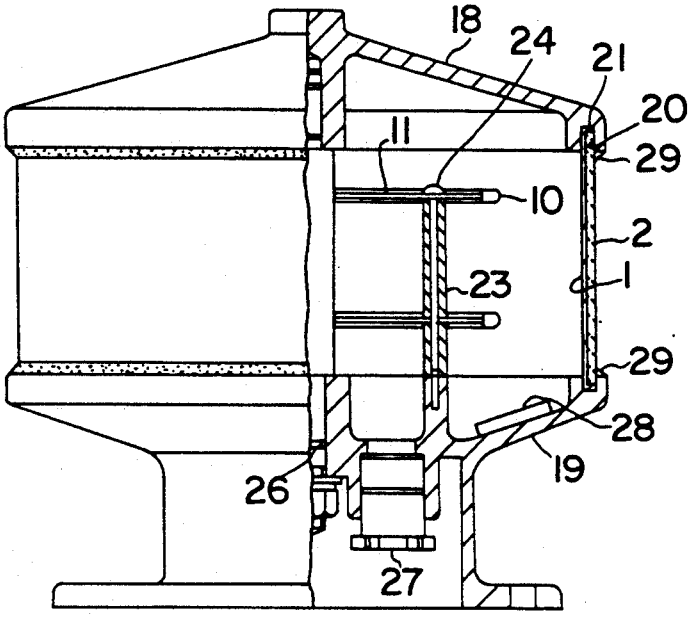
FIG. 6 is a partially cut-off front view of a lantern of another embodiment.

FIG. 6 is a partial cross section sectional front view of an embodiment, in which the transparent cylindrical cover 2 of the lantern lens of FIG. 5 is made of a single cover, and two thin fresnel lenses that are joined to the inner surface thereof are arranged parallel so as to contact each other, or the upper and lower lenses are formed on a single sheet of film, which is joined to the inner surface of the cover. In this embodiment, in order to further maintain the airtight of the lantern, sealing material 29 of silicon resin, etc. is used to seal the gap between the cove and the top lid 18, and the gap between the cover and the lower lantern body 19, to prevent water from going into the gap between the cover and the top lid and/or the lower lantern body respectively and avoid destruction of the lantern by freezing, etc. The lower lantern body and the center bolt are kept airtight by an O-ring 26 established on the center bolt, and the electric-wire-penetrating part in the lower lantern body is also kept airtight by a watertight electric-wire-penetrating fixture 27. Reference numeral 28 is a desiccant such as silica gel fastened to the inner surface of the lower lantern body.

Figure 7:
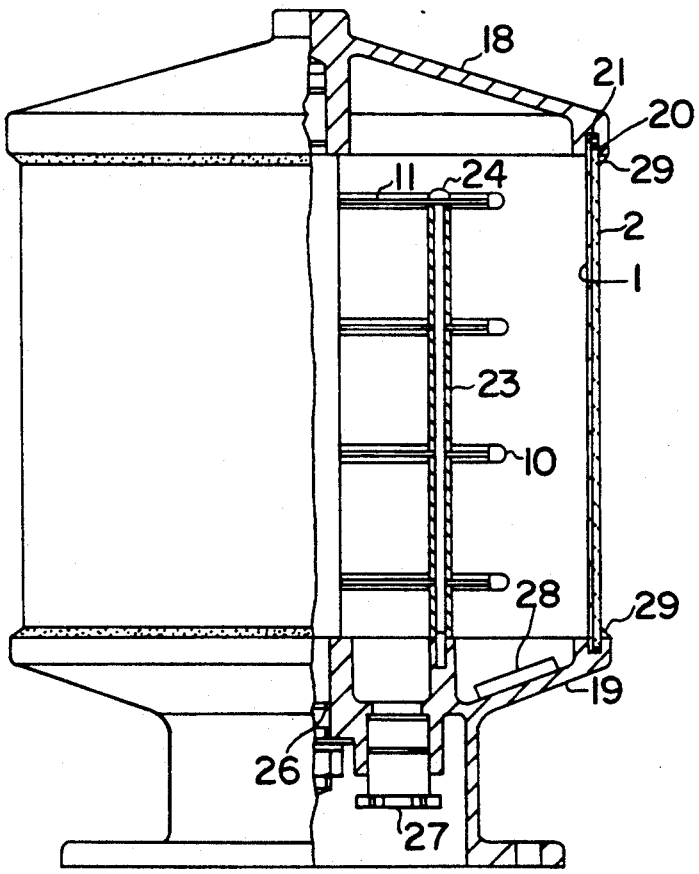
FIG. 7 is a partially cut-off front view of a lantern of another embodiment.

FIG. 7 shows an embodiment comprising the light source of LEDs that is established in four levels, in which a linear fresnel lens 1 is established in four levels, with each focal circle 1'' positioned at the LEDs of each level; and the linear fresnel lens is joined to the inner surface of the cover as a multi-level unit with each level connected to each other via upper and lower contact joints or as a single piece. The linear fresnel lens can also be cut in the longitudinal direction and provided with contact joints.

Figure 8:
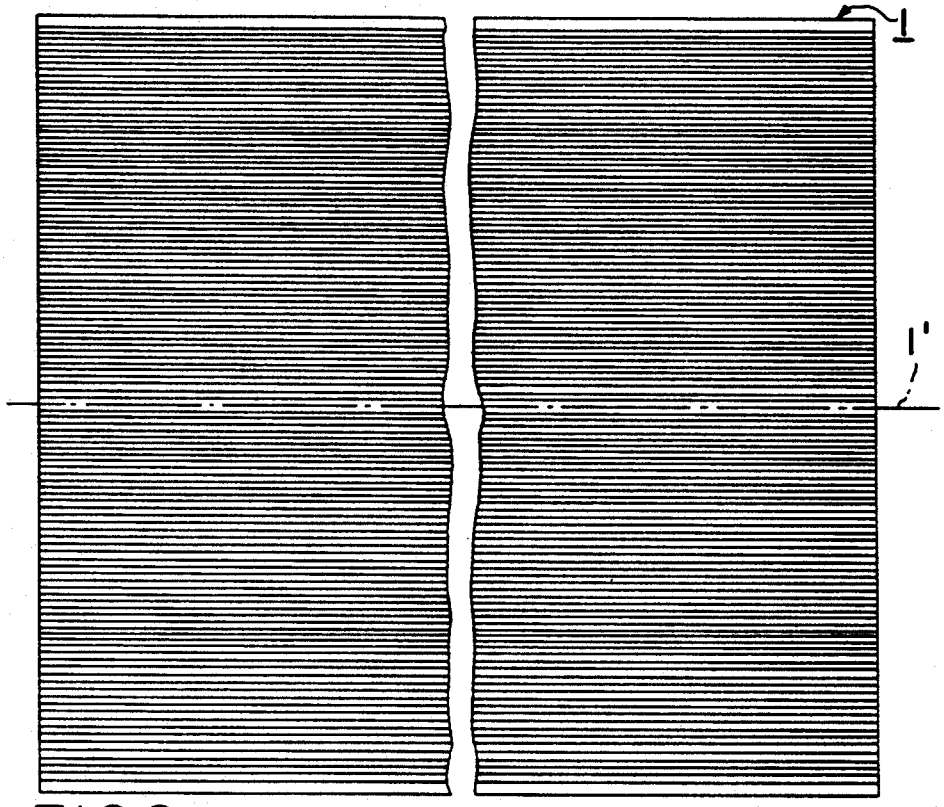
FIG. 8 is a plan view of a linear fresnel lens.
Figure 9:
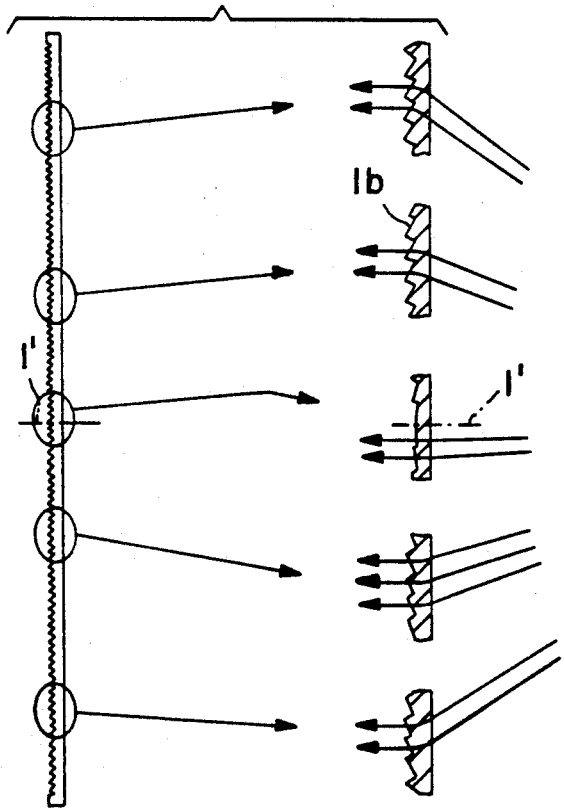
FIG. 9 is a side view of FIG. 8 and enlarged partial side views thereof.
Figure 10:
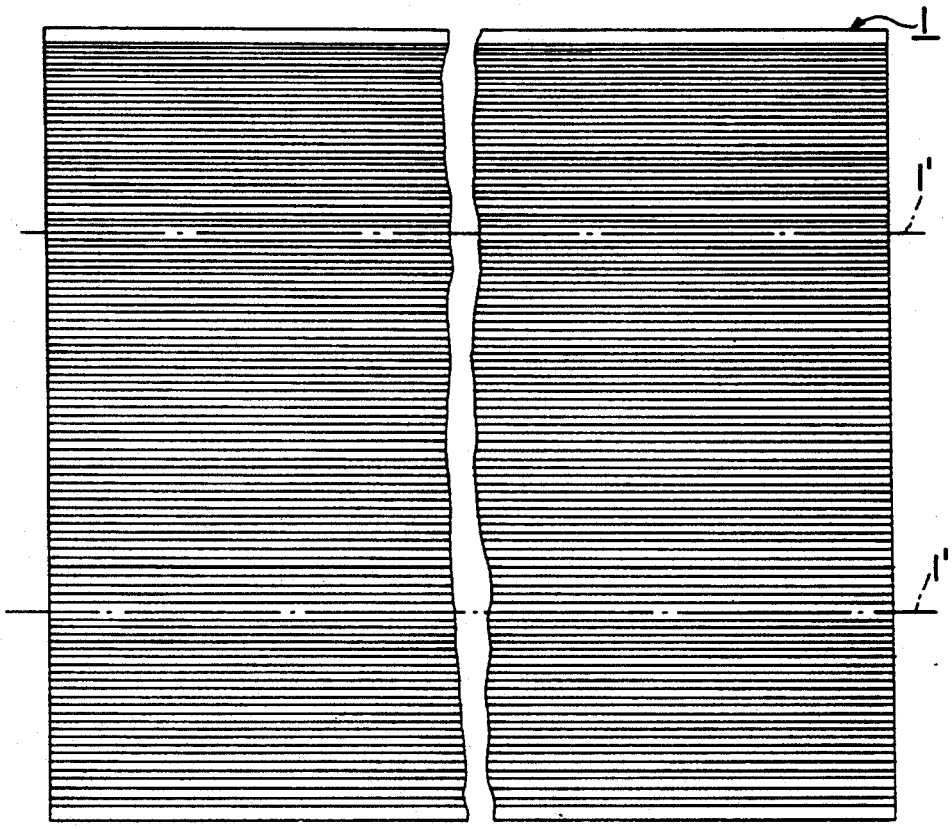
FIG. 10 is a plan view of another embodiment of a linear fresnel lens.
Figure 11:
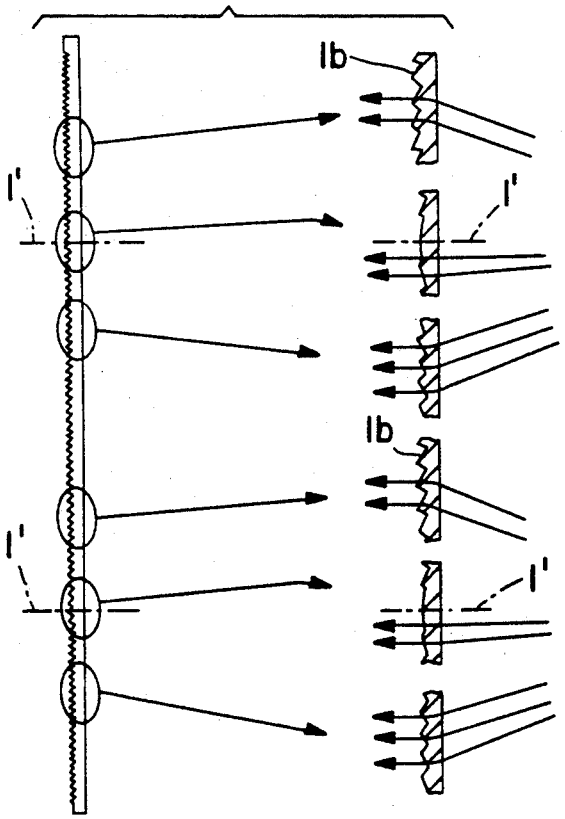
FIG. 11 is a side view of FIG. 10 and enlarged partial side views thereof.

FIGS. 8, 10, 11, 12, and 13 show the process of making a thin fresnel lens. FIG. 8 is a plan view of a linear fresnel lens 1 made of a fine prism-shaped linear fresnel lens surface formed on the transparent resin film of a flexible thin plate; FIG. 10 is a plan view of two linear fresnel lenses formed parallel on a single film surface, and FIGS. 9 and 11 are a side view and an enlarged partial view of FIG. 8 and 10, respectively. The arrows show the convergence (or path) of horizontal beams of light after passing through the lens. Reference numeral 1' is the center line of the fresnel lens, and lb is a linear light emitting surface of the lens.

Figure 12:
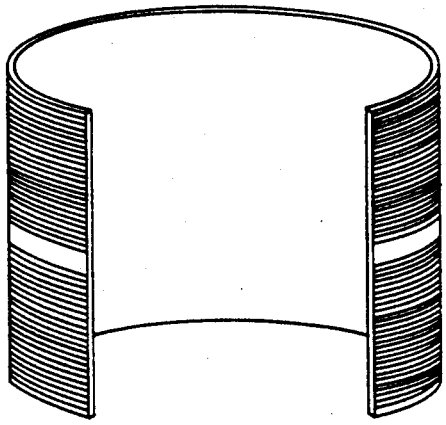
FIG. 12 is a process drawing of a thin cylindrical fresnel lens.
Figure 13:
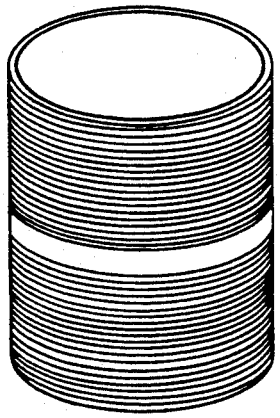
FIG. 13 is a process drawing of a thin cylindrical fresnel lens.
Figure 14:
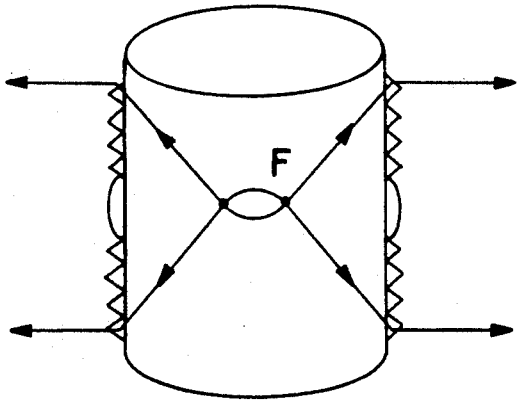
FIG.14 PRIOR ART
FIG. 14 is a conceptual drawing of a conventional cylindrical fresnel lens.

FIG. 12 shows a process of rolling the linear fresnel lens 1 in which the fresnel center line 1' forms a horizontal ring, and FIG. 13 is a perspective view of the cylindrical thin fresnel lens 1 which is made by completely rolling the linear fresnel lens and matching the edges. FIG. 14 is a conceptual drawing of a conventional cylindrical fresnel lens.

This manufacturing method allows the fresnel surface to be easily formed on either the outer or inner surface. With a conventional cylindrical lens, direct formation of a fresnel surface on the inner surface of a cover is impossible because it is difficult to remove the mold. However, by the method described above, a cylindrical lens with an inner fresnel lens can be easily produced by making a film with a fresnel surface on the inner surface thereof join with or adhere to the inner surface of the lens cover or a transparent cylinder. Also, by supporting the fresnel lens inner surface within the cover as shown in FIG. 1, or supporting it so as to join with the inner surface of the cylinder as shown in FIG. 2, 3, 5, 6, or 7, no force is applied to the cylindrical fresnel lens; therefore, the lens can be made as thin as possible, resulting in a high transmission factor.

In this embodiment, the light source of the lantern consisting of LEDs is arranged on a horizontal circumference, but the lantern lens of the present invention can also be applied to the ordinary beacon lantern having the light source in the center of the lantern, in which case the focal point of the lens should be arranged to be in the center of the lantern.

The lantern in accordance with claim 1 provides an economical beacon lantern and a lantern lens using LEDs consuming little energy, with good transmission factor of the lens, which is easy to manufacture, light, easy to make improvements thereto including a design change, with no possibility of disconnection nor need for maintenance, etc.

In addition to the above-mentioned effect, the lantern in accordance with claim 2 concentrates parts in the upper part of the cover, uses a short lead, eliminates disconnection, and prevents flooding of the flasher unit even in the rare case of flooding of the cover.

The lantern lens in accordance with claim 3 is made of an elastic sheet with a fine linear fresnel lens formed on the surface thereof, which is joined with the inner surface of the cylindrical cover. The edges of the sheet are joined each other while the elasticity of the sheet press the sheet against the inner surface of the cover. As such, a cylindrical fresnel lens is easily manufactured with excellent transmission factor. Also, the fresnel surface is not exposed to the outside air, requiring minimum maintenance such as cleaning.

In addition to the above-mentioned effects a shorter mold will suffice to manufacture the lantern lens in accordance with claim 4; therefore, it is easy to manufacture a lantern of a large diameter.

Using the lantern lens in accordance with claim 5, it is quite easy to manufacture a multi-level cylindrical fresnel lens.

Using the lantern lens in accordance with claim 6, it is possible to take advantage of the capability of a press to make a multi-level cylindrical fresnel lens even more easily.

Using the lantern lens in accordance with claim 7, a short mold is sufficient to manufacture a multi-level cylindrical fresnel lens, and it is quite easy to manufacture a cylindrical fresnel lens for a large lantern with large lighting power using multi-level LED light source.

Using the lantern lens in accordance with claim 8, the lantern can be assembled by tightening one center bolt only; therefore, it is easy to assemble the lantern, and force is applied evenly to the cylindrical cover, making possible a lantern with a thin cover and good light transmission.

Using the lantern in accordance with claim 9, in addition to the above-mentioned effects, it is possible to easily manufacture a large lantern with multiple-level LED light source.

Using the lantern in accordance with claim 10, it is possible to manufacture a large lantern with further efficiency, economy and lighting power.

Using the lantern in accordance with claim 11, it is possible to manufacture a lantern that is airtight, maintenance-free and semi-permanently usable with no possibility of dew condensation even if it is used in a cold region.

I claim:

1. A lantern comprising a light source of many LEDs radially distributed on a horizontal circumference and a cylindrical fresnel lens converging beams of light in all horizontal directions, in which the cylindrical fresnel lens is made by rolling a transparent film with a fine prism-shaped linear fresnel lens formed on a surface thereof, into a shape of a cylinder.

2. A lantern comprising a light source of many LEDs radially distributed on a horizontal circumference and a cylindrical fresnel lens converging beams of light in all horizontal directions, in which the cylindrical fresnel lens is made by rolling a transparent film with a fine prism-shaped linear fresnel lens formed on a surface thereof, into a shape of a frustum of a cone.

3. A lantern in accordance with claim 1 or 2 comprising:

transparent cover embedding a solar battery at an upper inner surface thereof;

a flasher unit case, in which an upper edge of the cylindrical fresnel lens is inserted into and fastened at an upper periphery thereof, a flasher unit is housed therein, the light source is supported in a bottom center thereof and mounted on a lower surface of an upper part of the cover; and a lens support that is inserted into and fastened at a lower inner surface of the cover and supports a lower edge of the cylindrical fresnel lens;

in which the thin cylindrical fresnel lens is supported concentrically with the cover maintaining a small gap between the lens and the inner surface of the cover.

4. A lantern in accordance with claim 1 or 2 in which the lantern is constructed airtight, and a desiccant is provided within the lantern to prevent dew condensation on the fresnel lens.

5. A lantern in which a top lid is supported at a prescribed position by a center bolt established at a lower lantern body, and a lantern lens is supported by inserting the same to cover-gripping slits individually established on the lower lantern body and a top lid, and many LEDs are radially arranged at a focal circle of the lantern lens; wherein said lantern lens is made by rolling a thin transparent film with a fine prism-shaped linear fresnel lens formed on a surface thereof and arranged in contact with an inner surface of a transparent cover having a shape of a cylinder with vertical side edges of said lens being in contact with each other.

6. A lantern in which a top lid is supported at a prescribed position by a center bolt established at a lower lantern body, and a lantern lens is supported by inserting the same to cover-gripping slits individually established on the lower lantern body and a top lid, and many LEDs are radially arranged at a focal circle of the lantern lens; wherein said lantern lens is made by rolling a thin transparent film with a fine prism-shaped linear fresnel lens formed on a surface thereof and arranged in contact with an inner surface of a transparent cover having a shape of a frustum of a cone with vertical side edges of said lens being in contact with each other.

7. A lantern in which a top lid is supported at a prescribed position by a center bolt established at a lower lantern body, and a lantern lens is supported by inserting the same to cover-gripping slits individually established on the lower lantern body and a top lid, and many LEDs are radially arranged at a focal circle of the lantern lens; wherein said lantern lens is made by rolling a plurality of thin transparent films each having a fine prism-shaped linear fresnel lens formed on a surface thereof and longitudinally arranged in contact with an inner surface of a transparent cover having a shape of a cylinder, in which adjoining side edges of said thin transparent films are in contact with each other.

8. A lantern in which a top lid is supported at a prescribed position by a center bolt established at a lower lantern body, and a lantern lens is supported by inserting the same to cover-gripping slits individually established on the lower lantern body and a top lid, and many LEDs are radially arranged at a focal circle of the lantern lens; wherein said lantern lens is made by rolling a plurality of thin transparent films each having a fine prism-shaped linear fresnel lens formed on a surface thereof and longitudinally arranged in contact with an inner surface of a transparent cover having a shape of a frustum of a cone, in which adjoining side edges of said thin transparent films are in contact with each other.

9. A lantern in which a top lid is supported at a prescribed position by a center bolt established at a lower lantern body, and several lantern lenses are inserted to cover-gripping slits individually established on the lower lantern body and a top lid, said lantern lenses are connected by a ring or rings that is or are provided with a cover-gripping slits on a top surface and bottom surface thereof, respectively, and many LEDs are radially arranged at a focal circle of each lantern lens in multiple levels; wherein each of said lantern lenses is made by rolling a thin transparent film with a fine prism-shaped linear fresnel lens formed on a surface thereof and arranged in contact with an inner surface of a transparent cover having a shape of a cylinder with vertical side edges of said lens being in contact with each other.

10. A lantern in which a top lid is supported at a prescribed position by a center bolt established at a lower lantern body, and several lantern lenses are inserted to cover-gripping slits individually established on the lower lantern body and a top lid, said lantern lenses are connected by a ring or rings that is provided with a cover-gripping slits on a top surface and bottom surface thereof, respectively, and many LEDs are radially arranged at a focal circle of each lantern lens in multiple levels; wherein each of said lantern lenses is made by rolling a thin transparent film with a fine prism-shaped linear fresnel lens formed on a surface thereof and arranged in contact with an inner surface of a transparent cover having a shape of a frustum of a cone with vertical side edges of said lens being in contact with each other.

11. A lantern in which a top lid is supported at a prescribed position by a center bolt established at a lower lantern body, and several lantern lenses are inserted to cover-gripping slits individually established on the lower lantern body and a top lid, said lantern lenses are connected by a ring or rings that is or are provided with a cover-gripping slits on a top surface and bottom surface thereof, respectively, and many LEDs are radially arranged at a focal circle of each lantern lens in multiple levels; wherein each of said lantern lenses is made by rolling a plurality of thin transparent films each having a fine prism-shaped linear fresnel lens formed on a surface thereof and longitudinally arranged in contact with an inner surface of a transparent cover having a shape of a cylinder, in which adjoining side edges of said thin transparent films are in contact with each other.

12. A lantern in which a top lid is supported at a prescribed position by a center bolt established at a lower lantern body, and several lantern lenses are inserted to cover-gripping slits individually established on the lower lantern body and a top lid, said lantern lenses are connected by a ring or rings that is or are provided with a cover-gripping slits on a top surface and bottom surface thereof, respectively, and many LEDs are radially arranged at a focal circle of each lantern lens in multiple levels; wherein each of said lantern lenses is made by rolling a plurality of thin transparent films each having a fine prism-shaped linear fresnel lens formed on a surface thereof and longitudinally arranged in contact with an inner surface of a transparent cover having a shape of a frustum of a cone, in which adjoining side edges of said thin transparent films are in contact with each other.

13. A lantern in accordance with claim 1, 2, 5, 6, 7, 8, 9, 10, 11 or 12 in which the lantern is constructed airtight, and a desiccant is provided within the lantern to prevent dew condensation on the fresnel lens.

14. A lantern in which a top lid is supported at a prescribed position by a center bolt established at a lower lantern body, and several lantern lenses are arranged in parallel in multiple levels so as to contact each other and inserted to cover-gripping slits individually established on the lower lantern body and the top lid, and many LEDs are radially arranged at a focal circle of each lantern lens in said multiple levels; wherein each of said lantern lenses is made by rolling a thin transparent film with a fine prism-shaped linear fresnel lens formed on a surface thereof and arranged in contact with an inner surface of a transparent cover having a shape of a cylinder with vertical side edges of said lens being in contact with each other.

15. A lantern in which a top lid is supported at a prescribed position by a center bolt established at a lower lantern body, and a lantern lens is supported by inserting the same to cover-gripping slits individually established on the lower lantern body and the top lid; wherein said lantern lens is made by rolling a single transparent film having a plurality of fine prism-shaped linear fresnel lenses formed on a surface thereof and arranged in parallel in multiple levels in contact with an inner surface of a transparent cover having a shape of a cylinder with vertical side edges of said lantern lens being in contact with each other and many LEDs are radially arranged at a focal circle of each said linear fresnel lens in said multiple levels.

16. A lantern in which a top lid is supported at a prescribed position by a center bolt established at a lower lantern body, and several lantern lenses are arranged in parallel in multiple levels so as to contact each other and inserted to cover-gripping slits individually established on the lower lantern body and the top lid, and many LEDs are radially arranged at a focal circle of each lantern lens in said multiple levels; wherein each of said lantern lens is made by rolling a plurality of thin transparent films each having a fine prism-shaped linear fresnel lenses formed on a surface thereof and longitudinally arranged in contact with an inner surface of a transparent cover having a shape of a cylinder, in which adjoining side edges of said thin transparent films are in contact with each other.

17. A lantern in accordance with claim 1, 2, 5, 6, 7, 8, 9, 10, 11, 12, 14, 15 or 16, in which the lantern is constructed air-tight, and a desiccant is provided within the lantern to prevent dew condensation on the fresnel lens.

18. A lantern in which a top lid is supported at a prescribed position by a center bolt established at a lower lantern body, and a lantern lens made by rolling a thin transparent film with a fine prism-shaped linear fresnel lens formed on a surface thereof and arranged in contact with an inner surface of a transparent cover having a shape of a cylinder with vertical side edges of said lens being in contact with each other is supported by inserting the same to cover-gripping slips individually established on the lower lantern body and a top lid, and many LEDs are radially arranged at a focal circle at the lantern lens.

19. A lantern in which a top lid is supported at a prescribed position by a center bolt established at a lower lantern body, and several lantern lenses made by rolling a thin transparent film with a fine prism-shaped linear fresnel lens formed on a surface thereof and arranged in contact with an inner surface of a transparent cover having a shape of a cylinder with vertical side edges of said lens being in contact with each other are inserted to cover-gripping slits individually established on the lower lantern body and a top lid, said lantern lenses are connected by a ring or rings that is or are provided with a cover-gripping slits on a top surface and bottom surface thereof respectively, and many LEDs are radially arranged at a focal circle of each lens in multiple levels.

20. A lantern in which a top lid is supported at a prescribed position by a center bolt established at a lower lantern body, and several lantern lenses made by rolling a plurality of thin transparent films each having a fine prism-shaped linear fresnel lens formed on a surface thereof and longitudinally arranged in contact with an inner surface of a transparent cover having a shape of a cylinder wherein adjoining side edges of said thin transparent films are in contact with each other are inserted to cover-gripping slits individually established on a lower lantern body and a top lid, said lantern lenses are connected by a ring or rings that is or are provided with cover gripping slits on a top surface and bottom surface thereof, respectively, and many LEDs are radially arranged at a focal circle of each lantern lens in multiple levels.

21. A lantern in which a top lid is supported at a prescribed position by a center bolt established at a lower lantern body, and several lantern lens made by rolling a thin transparent film with a fine prism-shaped linear fresnel lens formed on a surface thereof and arranged in contact with an inner surface of a transparent cover having a shape of a frustum of a cone with vertical side edges of said lens being in contact with each other are inserted to cover-gripping slits individually established on the lantern body and a top lid, said lantern lenses are connected by a ring or rings that is or are provided with cover gripping slits on a top surface and bottom surface thereof, respectively, and many LEDs are radially arrange at a focal circle of said lantern lens in multiple levels.

22. A lantern in accordance with claim 20 or 21 in which the lantern is constructed air tight, and a desiccant is provided within the lantern to prevent dew condensation on the fresnel lens.

23. A lantern in which a top lid is supported at a prescribed position by a center bolt established at a lower lantern body, and a lens made by rolling a thin transparent film with a fine prism-shaped linear fresnel lens formed on a surface thereof and joining the same to an inner surface of a transparent cylindrical cover, in which several linear fresnel lenses are arranged parallel in a longitudinal direction so as to contact each other is inserted to cover-gripping slits individually provided on the lower lantern body and a top lid.

24. A lantern in accordance with claim 23, in which the lantern is constructed air tight, and a desiccant is provided within the lantern to prevent dew condensation on the fresnel lens.

25. A lantern in which a top lid is supported at a prescribed position by a center bolt established at a lower lantern body, and a lantern lens made by rolling a plurality of thin transparent films each having a fine prism-shaped linear fresnel lens formed on a surface thereof and longitudinally arranged in contact with an inner surface of a transparent cover having a shape of a cylinder and wherein adjoining side edges of said thin transparent films are in contact with each other is supported by inserting the same to cover-gripping slits individually established on the lower lantern body and a top lid, and many LEDs are radially arranged at a focal circle of the lantern lens.

26. A lantern in which a top lid is supported at a prescribed position by a center bolt established at a lower lantern body, and a lantern lens made by rolling a plurality of thin transparent films each having a fine prism-shaped linear fresnel lens formed on a surface thereof and longitudinally arranged in contact with an inner surface of a transparent cover having a shape of a frustum of a cone and wherein adjoining side edges of said thin transparent films are in contact with each other is supported by inserting the same to cover-gripping slits individually established on the lower lantern body and a top lid, and many LEDs are radially arranged at a focal circle of the lantern lens.

27. A lantern in which a top lid is supported at a prescribed position by a center bolt established at a lower lantern body, and a lantern lens made by rolling a thin transparent film with a fine prism-shaped linear fresnel lens formed on a surface thereof and arranged in contact with an inner surface of a transparent cover having a shape of a frustum of a cone with vertical side edges of said lens being in contact with each other is supported by inserting the same to cover-gripping slits individually established on the lower lantern body and a top lid, and many LEDs are radially arranged at a focal circle of the lantern lens.

28. A lantern in which a top lid is supported at a prescribed position by a center bolt established at a lower lantern body, and a lens made by rolling a thin transparent film with several fine prism-shaped linear fresnel lenses formed on a surface thereof and joining the same to an inner surface of a transparent cylindrical cover in which said several linear fresnel lenses are arranged parallel in a longitudinal direction so as to contact each other is inserted to cover-gripping slits individually provided on the lower lantern body and a top lid.

29. A lantern in which a top lid is supported at a prescribed position by a center bolt established at a lower lantern body, and a lens made by rolling a plurality of thin transparent films each having a fine prism-shaped linear fresnel lens formed on a surface thereof and wherein said thin transparent films are arranged longitudinally and transversely in contact with an inner surface of a transparent cover having a shape of a cylinder so that adjoining transverse edges and adjoining side edges of said thin transparent film are in contact with each other, said lens being inserted to cover gripping slits individually provided on the lower lantern body and a top lid.

* * * * *